US011441282B2

(12) United States Patent
Caviness

(10) Patent No.: US 11,441,282 B2
(45) Date of Patent: Sep. 13, 2022

(54) PORTABLE SNOW AND ICE ELIMINATOR APPARATUS AND METHOD

(71) Applicant: Tyana Caviness, Yonkers, NY (US)

(72) Inventor: Tyana Caviness, Yonkers, NY (US)

( * ) Notice: Subject to any disclaimer, the term of this patent is extended or adjusted under 35 U.S.C. 154(b) by 471 days.

(21) Appl. No.: 16/660,106

(22) Filed: Oct. 22, 2019

(65) Prior Publication Data

US 2021/0115637 A1 Apr. 22, 2021

(51) Int. Cl.
*E01H 5/10* (2006.01)

(52) U.S. Cl.
CPC ..... *E01H 5/102* (2013.01)

(58) Field of Classification Search
CPC ..... E01H 5/10; E01H 5/102; E01H 5/104
See application file for complete search history.

(56) References Cited

U.S. PATENT DOCUMENTS 553,401 A * 1/1896 Von Garnier ..... E01H 5/102 126/343.5 R
2,783,554 A * 3/1957 Schmitz ..... E01H 5/04 37/229
3,140,708 A * 7/1964 Petlak ..... E01H 5/102 37/227
3,261,965 A * 7/1966 Kerznar ..... E01H 5/102 392/458
3,333,354 A * 8/1967 Kirshenblat ..... E01H 5/104 219/202
3,353,286 A * 11/1967 Marks ..... E01H 5/104 126/343.5 R
4,071,966 A * 2/1978 Cohen ..... E01H 5/104 193/31 A
4,697,572 A * 10/1987 James ..... E01H 5/102 37/227
5,079,865 A * 1/1992 Hutson ..... E01H 5/104 37/238
5,235,762 A * 8/1993 Brady ..... E01H 5/102 298/1 H
5,638,988 A * 6/1997 Rogers ..... A01C 15/003 141/330
5,791,335 A * 8/1998 Luciani ..... E01H 5/102 126/343.5 R
10,006,182 B1 * 6/2018 Cho ..... E01H 5/104
2004/0074114 A1 * 4/2004 Rogers ..... E01H 5/104 37/228
2006/0272182 A1 * 12/2006 Gertner ..... E01H 5/104 37/227
2009/0217554 A1 * 9/2009 Tucker ..... E01H 5/102 37/228

(Continued)

*Primary Examiner* — Jamie L McGowan
(74) *Attorney, Agent, or Firm* — Grant Attorneys at Law PLLC; Kristin Grant; John Laurence

(57) ABSTRACT

A portable snow and ice melting apparatus including a hopper with opposite side walls and opposite end walls, the side and end walls extending vertically from a base as to define an internal cavity, a first melting panel and a second melting panel positioned within the internal cavity, the second melting panel rotating between an open position and the closed position, a first heating element heating the first melting panel to an operating temperature and a second heating element heating the second melting panel to the operating temperature, the operating temperature sufficient to melt snow and ice deposited within the hopper.

19 Claims, 7 Drawing Sheets

(56) References Cited

U.S. PATENT DOCUMENTS

| | | | | |
|---|---|---|---|---|
| 2015/0275449 | A1* | 10/2015 | Sanchez | E01H 5/102<br>432/88 |
| 2017/0114511 | A1* | 4/2017 | Amani | E01H 5/102 |
| 2017/0152639 | A1* | 6/2017 | Cho | E01H 5/106 |
| 2018/0044870 | A1* | 2/2018 | Soni | E01H 5/104 |
| 2019/0368146 | A1* | 12/2019 | Hochsprung | E01H 5/10 |

* cited by examiner

PORTABLE SNOW AND ICE ELIMINATOR APPARATUS AND METHOD

FIELD

This application relates to a portable snow eliminator apparatus and method, and more particularly to a portable apparatus including melting panels that are heated to melt snow and ice to a liquid or semi-liquid state using embedded or attached heating elements which are enabled by placing snow and ice onto the melting panels.

BACKGROUND

The removal of snow and ice has always been a problem. The conventional approach has been to move snow and ice out of the way through the use of plows, tractors, and shovels. Once a street or driveway has been cleared, the snow or ice is stockpiled wherever there is sufficient space which often is on the side of the cleared street and driveway.

However, finding adequate space to stockpile snow and ice for extended periods is often a problem. In major cities, snow and ice are often trucked away to outlying areas, deposited in parks, or dumped into rivers or lakes. However, many individuals and cities do not have the trucks and other equipment necessary to transport stockpiled snow and ice. Moreover, even if the necessary trucks and equipment are available, the transportation of snow and ice can be expensive in terms of man hours and fuel costs.

One way to overcome these difficulties is to melt the snow and ice into a liquid or semi liquid state at its original location or where it has been stockpiled. The resulting water may be disposed of in any nearby drain or sewer. This precludes the need to stockpile snow and ice for extended periods or to transport it to other locations for disposal.

It is a primary objective of the present invention to provide a portable snow and ice eliminator apparatus and method which effectively and reliably provides for the melting of snow and ice and the disposal of the resulting water.

SUMMARY

In some embodiments, a portable snow and ice melting apparatus is provided. The portable snow and ice melting apparatus including a hopper for receiving snow or ice to be melted to liquid or semi-liquid state, the hopper being generally rectangular with opposite side walls and opposite end walls, the side walls and the end walls extending vertically from a base as to define an internal cavity, a first melting panel fixedly coupled to a first side wall of the opposite side walls and extending substantially over the length of the internal cavity and half of the width of the internal cavity, a second melting panel rotatably coupled to a second side wall of the opposite side walls and extending substantially over the length of the internal cavity and half of the width of the internal cavity, the second melting panel rotating between an open position and the closed position, and a first heating elements embedded within the first melting panel and a second heating element embedded within the second inching panel. The portable snow and ice melting apparatus further including a water collector positioned above the base and below the first melting panel and the second melting panel, the water collection extending substantially over the base, a switch coupled to the second melting panel, the switch being in an off state while the second melting panel is in the open position and an on state while the second melting panel is in the closed position, a rechargeable battery positioned within the internal cavity and electrically connected to the first heating element and the second heating element through the switch, and a solar panel mechanically coupled to the hopper and electrically connected to the battery, the solar panel transitioning between a storage position proximate the internal cavity and an operating position remote of the internal cavity.

In some embodiments, a method of melting snow and ice is provided, the method including the steps of depositing snow or ice into the internal cavity of a hopper, positioning the deposited snow or ice onto a first melting panel and a second melting panel positioned within the internal cavity, rotating the second melting panel from an open position remote from the first melting panel to a closed position proximate to the first melting panel as a result of the weight of the deposited snow or ice, heating the first melting panel and second melting panel by enabling a flow of current through both the first melting panel and the second melting panel once the second melting panel has rotated to the closed position, melting the deposited snow or ice by using heat emanating from the first melting panel and the second heating panel, and collecting at least a portion of the melted snow or ice in a water collector positioned below both the first melting panel and the second melting panel within the internal cavity.

Still, other aspects, features, and advantages of this disclosure may be readily apparent from the following detailed description as illustrates by several example embodiments. This disclosure may also be capable of other and different embodiments, and its several details may be modified in various respects. Accordingly, the drawings and descriptions are to be regarded as illustrative and not as restrictive.

BRIEF DESCRIPTION OF THE DRAWINGS

The drawings, described below, are for illustrative purposes only and are not necessarily drawn to scale. The drawings are not intended to limit the scope of the invention in any way. Wherever possible, the same or like reference numbers are used throughout the drawings to refer to the same or like parts.

DETAILED DESCRIPTION

As mentioned above, this application relates to a portable snow eliminator apparatus, and more particularly to a configuration for a portable apparatus that melts snow and ice to a liquid or semi-liquid state. The apparatus may include a first melting panel and a second melting panel enclosed with a hopper. The first and second melting panels are heated to a desired operating temperature by embedded or attached resistive heating elements. Specifically, a first heating element is either embedded within the first melting panel or attached to one or more of its surfaces. Similarly, a second heating element is either embedded within the second melting panel or attached to one or more of its surfaces. Once snow and ice are melted to a liquid or semi liquid state by the first and second melting panels, it is collected within a water collector pan and then drained out of the hopper.

The first and second heating elements are electrically connected to a rechargeable battery positioned within the hopper. The rechargeable battery is electrically connected to a solar panel, thereby allowing for solar based recharging of the battery.

The apparatus may further include filters enclosed within the hopper that remove debris from the melted snow and ice before it is collected within the water collector.

Figure 1:
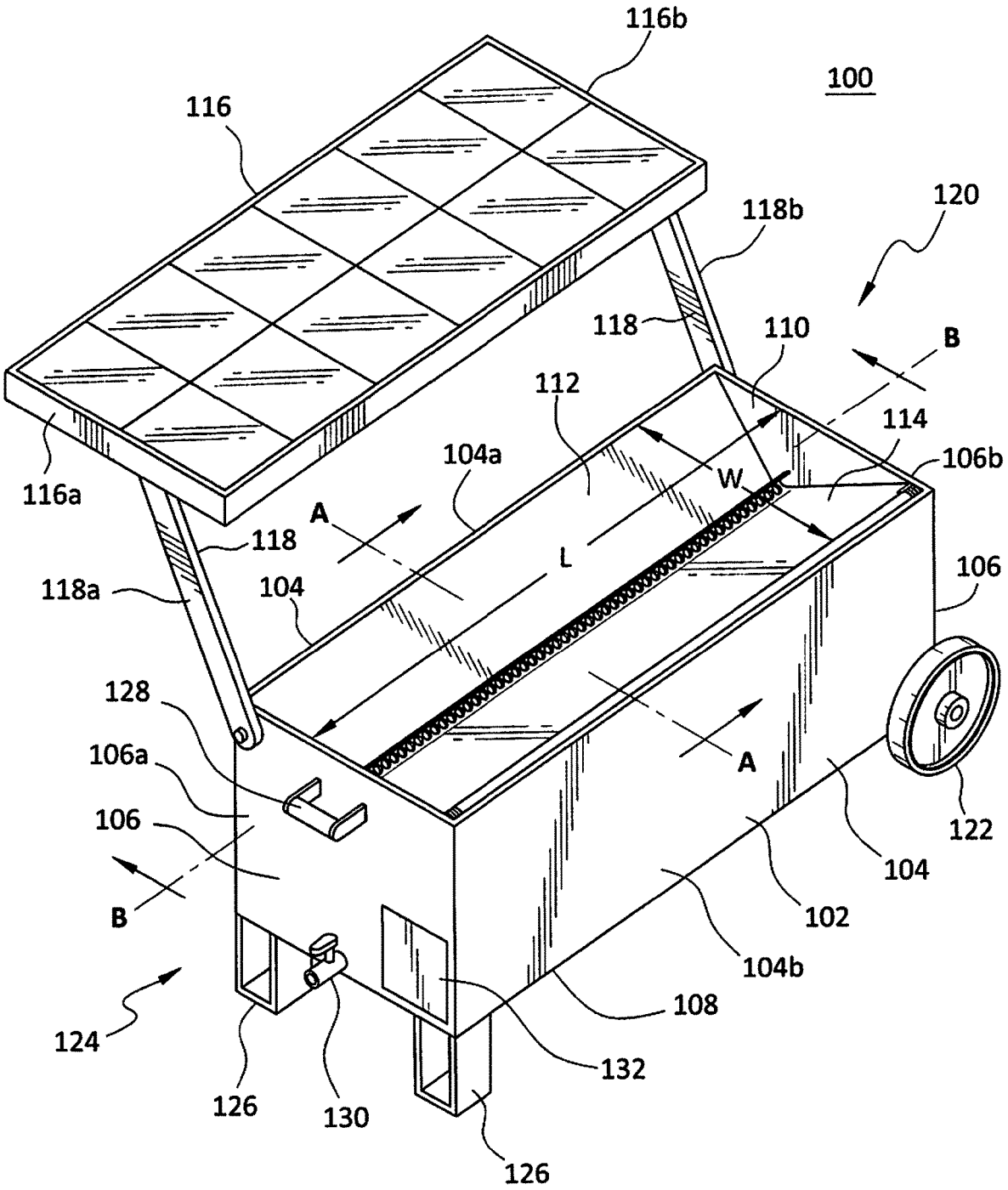
FIG. 1 illustrates a top perspective view of a portable snow and ice eliminator apparatus in accordance with the embodiments provided herein.

FIG. 1 illustrates a top perspective view of a portable snow and ice eliminator apparatus 100 in accordance with the embodiments provided herein. The portable snow and ice eliminator apparatus 100 includes a hopper 102 that is generally rectangular shaped with opposing side walls 104 and the opposing end walls 106. The opposing side walls 104 and the opposing end wall 106 extending from a base 108 and coupled to one another as to define an internal cavity 110 within the hopper 102.

The opposing side walls 104, the opposing end walls 106, and the base 108 may each be composed of any rigid and waterproof material known to one of ordinary skill in the art including steel, aluminum, and plastic or any combination thereof.

The opposing side walls 104 may include a first side wall 104*a* and a second side wall 104*b* that is opposite the first side wall 104*a*. Similarly, the opposing end walls 106 may include a first end wall 106*a* and a second end wall 106*b* that is opposite the first end wall 106*a*.

In one embodiment, the hopper dimensions may be approximately 15 feet long by 5 feet wide by 4 feet high.

In one embodiment, the first side wall 104*a* and the second side wall 104*b* extend parallel to one another from the base 108. Similarly, the first end wall 106*a* and the second end wall 106*b* extend parallel to one another from the base 108.

A first melting panel 112 may be fixedly coupled to the first side wall 104*a* at an angle relative to the first side wall 104*a*. At this angle, the first melting panel 112 protrudes from the first side wall 104*a* downward towards the base 108 and into the internal cavity 110. The first melting panel 112 extends substantially along the length L of the internal cavity 110 and across approximately half the width W of the internal cavity 110.

In one embodiment, the first melting panel 112 is mounted to the first side wall 104*a* at approximately a 45 degree angle relative to the first side wall 104*a*.

A second melting panel 114 may be rotatably coupled to the second side wall 104*b*. The second melting panel 114 rotates about a rotatable coupling between an open position and a closed position.

Similar to the first melting panel 112, the second melting panel 114 extends substantially along the length L of the internal cavity 110 and across approximately half the width W of the internal cavity 110.

In one embodiment, the second melting panel 114 rotates between the open position at an approximately a 90 degree angle relative to the second side wall 104*b* and the closed position at an approximately 45 degree angle relative to the second side wall 104*b*.

In one embodiment, the first and second melting panel 112, 114 may each be dimensioned to be approximately 13.5 feet long and 2.5 feet wide.

A solar panel 116 may be coupled to the hopper 102 via opposing elevating arms 118.

Similar to the hopper 102, the solar panel 116 may have a generally rectangular shape with a first transversal end 116*a* generally aligned with the first end wall 106*a* and a second transversal end 116*b* generally aligned with the second end wall 106*b*.

The elevating arms 118 may include a first elevating arm 118*a* and a second elevating arm 118*b* that is opposite the first elevating arm 118*a*. The first elevating arm 118*a* may be movably coupled to both the first transversal end 116*a* of the solar panel 116 and to the first end wall 106*a*. Similarly, the second elevating arm 118*b* may be movably coupled to both the second transversal end 116*b* of the solar panel 116 and to the second end wall 106*b*.

The elevating arms 118 may lift and tilt the solar panel 116 as to transition the solar panel 116 between a storage position that is proximate the internal cavity 110 and an operating position that is remote of the internal cavity 110.

The hopper 102 may include a back end 120 and a front end 124 that is opposite the back end 120.

A pair of wheels 122 may be coupled to opposite sides of the base 108 proximate the second end wall 106*b* near the back end 120 of the hopper 102. The pair of wheels 122 are dimensioned and positioned as to elevate the back end 120 above a surface on which the pair of wheels 122 are positioned.

A pair of feet 126 may be coupled to opposite sides of the base 108 proximate the first end wall 106*a* near the front end 124 of the hopper. The pair of feet 126 are dimensioned and positioned to elevate the front end 124 off of the surface on which the pair of feet 126 are positioned.

The front end 124 of the hopper 102 may be elevated by the same amount as the back end 120. Alternatively, the front end 124 of the hopper 102 may be elevated by a different amount than the back end 120.

A handle 128 may be coupled to the first end wall 106*a* at the front end 124 of the hopper 102. The handle 128 enables a user to lift the front end 124 and freely roll the hopper 102 on the pair of wheels 122.

A water release valve 130 may be positioned on the first end wall 106*a*. The water release valve 130 may traverse through the first end wall 106*a* as to be in communication with the internal cavity 110 of the hopper 102.

An access door 132 may be included in the first end wall 106*a*, the access door 132 providing access to a portion of the internal cavity 110.

Figure 2:
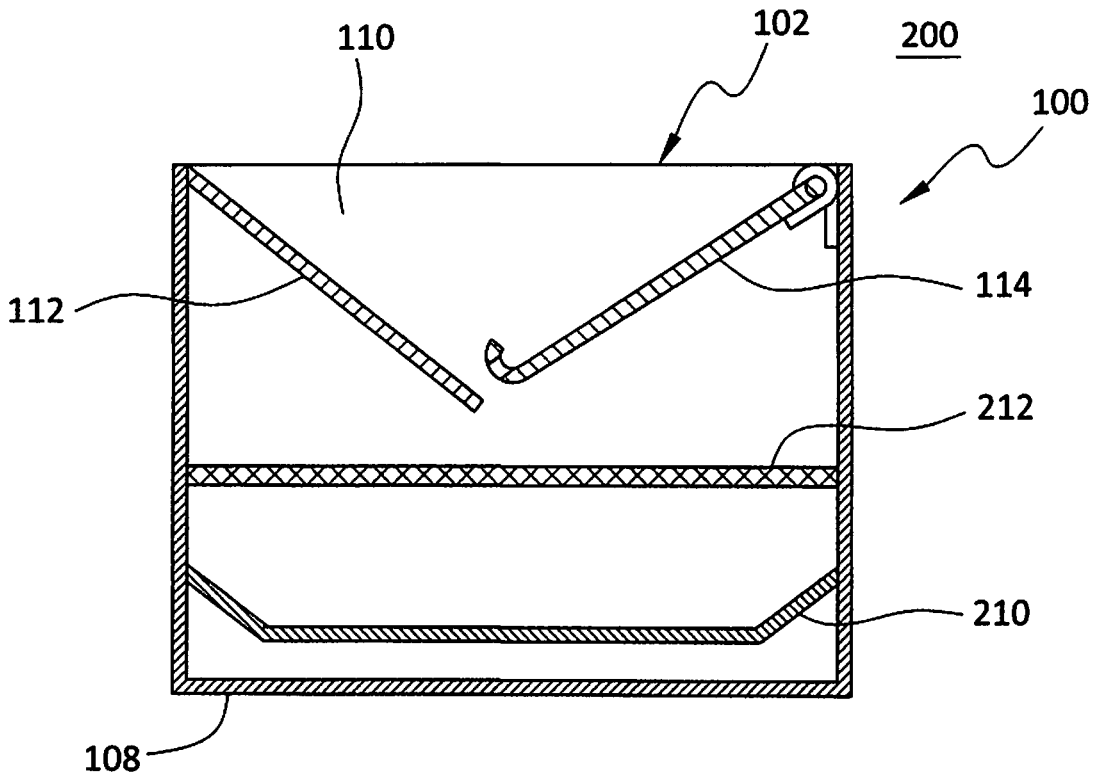
FIG. 2 illustrates a cross-sectional view of the internal cavity of the portable snow and ice eliminator apparatus along the transversal dashed line A in FIG. 1 in accordance with the embodiments provided herein.

FIG. 2 illustrates a cross-sectional view 200 of the internal cavity 110 of the portable snow and ice eliminator apparatus 100 along transversal dashed line A in FIG. 1 in accordance with the embodiments provided herein. The hopper 102 may include a water collector 210 and a screen member 212 positioned and fully encapsulated within the internal cavity 110. Specifically, the water collector 210 may be positioned in-between the base 108 and the first and second melting panel 112, 114 within the internal cavity 110. The screen member 212 may be positioned in-between the water collector 210 and the first and second melting panel 112, 114 within the internal cavity 110.

The water collector 210 may be designed to collect snow and ice that has been melted to a liquid or a semi-liquid state and has then passed through the screen member 212. The water collector 210 may be dimensioned and sized to extend substantially over the full area of the base 108.

The screen member 212 may be designed to block debris while allowing snow or ice that has been melted to a liquid or a semi-liquid state to pass through to the water collector 210. The screen member 212 may be dimensioned and sized to extend substantially over the full area of the water collector 210.

Figure 3:
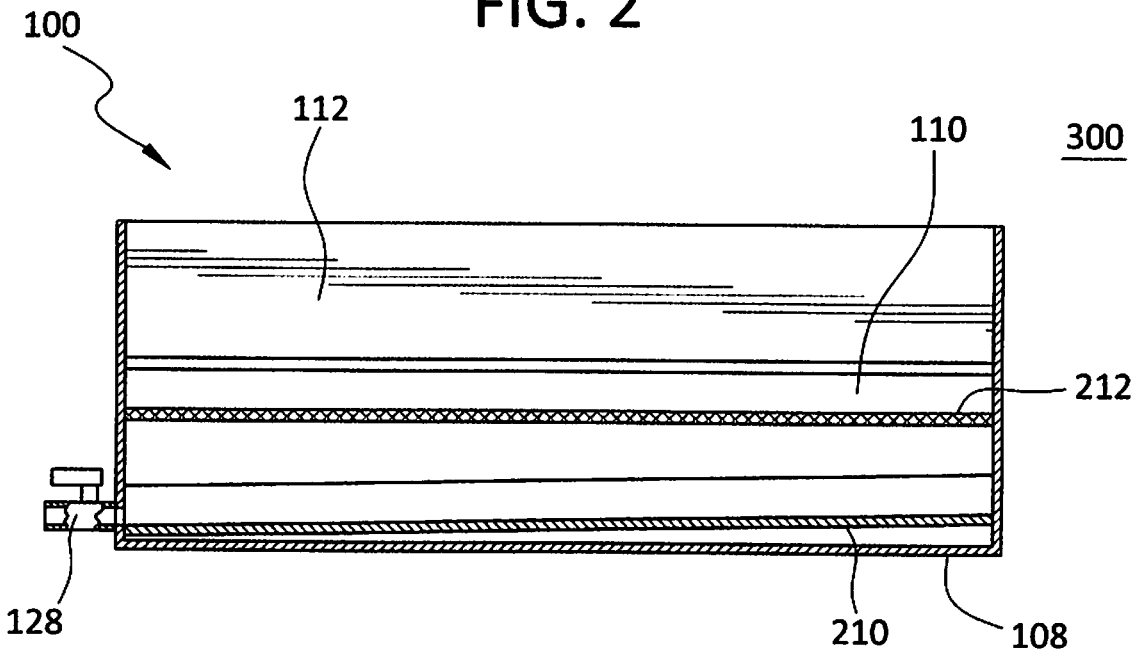
FIG. 3 illustrates a cross-sectional view of the internal cavity of the portable snow and ice eliminator apparatus along longitudinal dashed line B in FIG. 1 in accordance with the embodiments provided herein.

FIG. 3 illustrates a cross-sectional view 300 of the internal cavity 110 of the portable snow and ice eliminator apparatus 100 along longitudinal dashed line B in FIG. 1 in accordance with the embodiments provided herein. The water collector 210 may be shaped and slanted as to bias any liquid or a semi-liquid within the water collector 210 towards the water release valve 130.

The water release valve 130 may be in communication with the water collector 210 to allow any liquids or semi liquids within the water collector 210 to drain out from within the internal cavity 110.

Figure 4A:
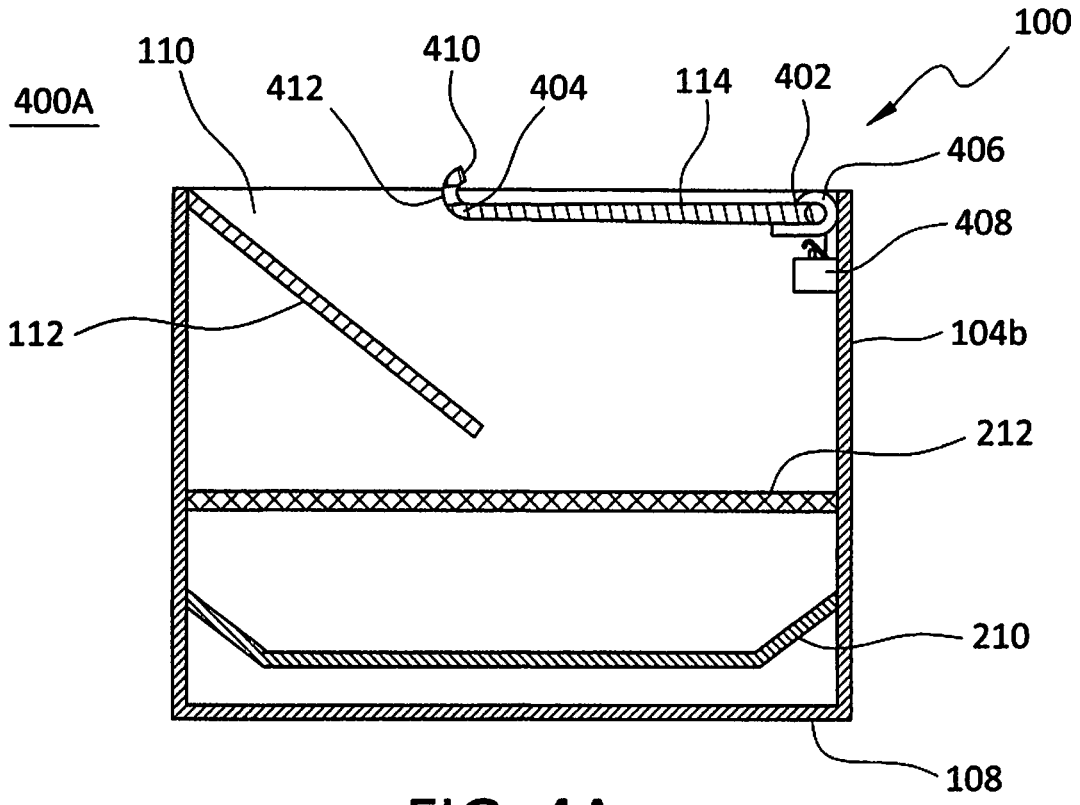
FIG. 4A illustrates a cross-sectional view of the internal cavity of the portable snow and ice eliminator apparatus along longitudinal dashed line B in FIG. 1 with the second melting panel 114 in the open position in accordance with the embodiments provided herein.

FIG. 4A illustrates a cross-sectional view 400A of the internal cavity 110 of the portable snow and ice eliminator apparatus 100 along longitudinal dashed line B in FIG. 1 with the second melting panel 114 in the open position in accordance with the embodiments provided herein. In the open position, the second melting panel 114 may be rotated to a position that is at an angle of approximately 90 degrees relative to the second side wall 104*b*. In the open position, a larger gap exists between the first melting panel 112 and the second melting panel 114 within the internal cavity 110.

Figure 4B:
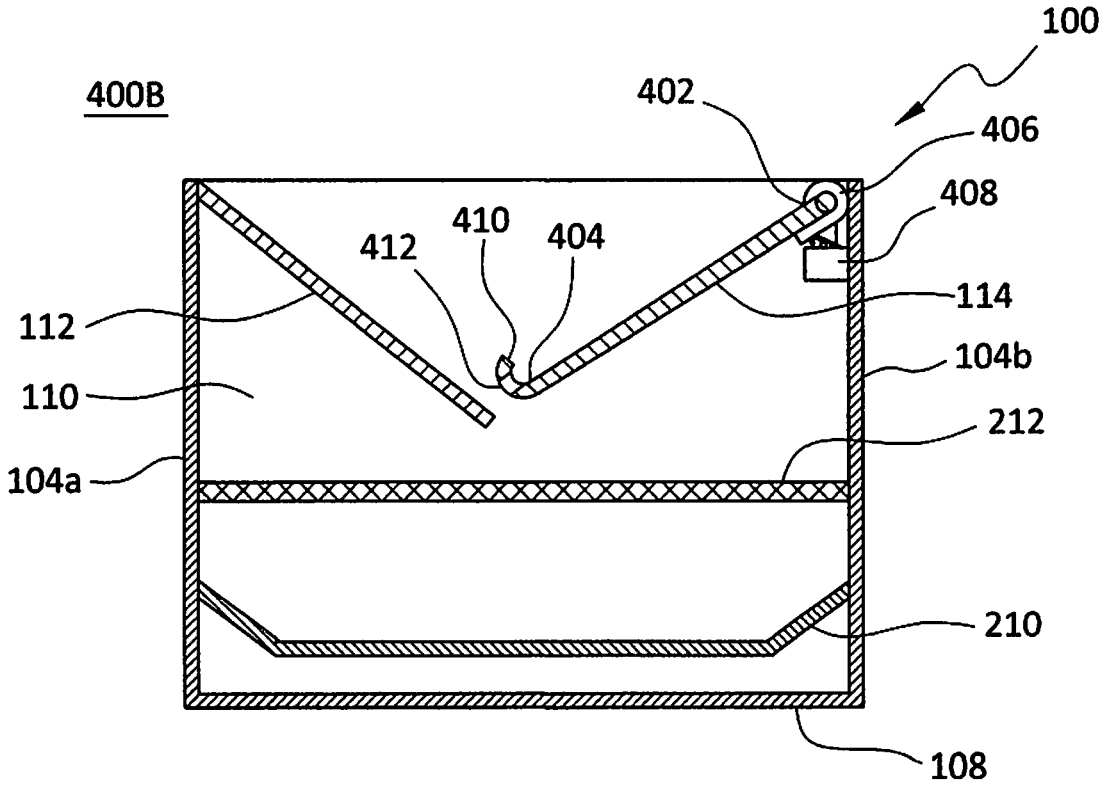
FIG. 4B illustrates a front view of the second melting panel in a closed position in accordance with the embodiments provided herein.

FIG. 4B illustrates a cross-sectional view 400B of the internal cavity 110 of the portable snow and ice eliminator apparatus 100 along longitudinal dashed line B in FIG. 1 with the second melting panel 114 in the closed position in accordance with the embodiments provided herein. In the closed position, the second melting panel 114 may be rotated to a position that is at an angle of approximately 45 degrees relative to the second side wall 104*b*. In the closed position, a smaller gap may exist between the first melting panel 112 and the second melting panel 114 within the internal cavity 110. Alternatively, in the closed position, the second melting panel 114 may come in direct contact with the first melting panel 112 such that no gap exists between the first melting panel 112 and the second melting panel 114 within the internal cavity 110.

As shown in FIGS. 4A and 4B, the second melting panel 114 may include a first longitudinal edge 402 and a second longitudinal edge 404 that is opposite the first longitudinal edge 402.

The first longitudinal edge 402 may be rotatably coupled to the second side wall 104*b*. This rotatable coupling at the first longitudinal edge 402 allows the second melting panel 114 to rotate between the open position and the closed position.

The rotatable coupling may be of any type known to a person of ordinary skill in the art including standard hinges.

A spring 406 may be secured to the first longitudinal edge 402. The spring 406 may be configured to bias the second melting panel 114 towards the open position.

A sufficient amount of weight in the form of snow or ice positioned on the second melting panel 114 may overcome the bias of the spring 406. Once the bias of the spring 406 is overcome, the second melting panel 114 may rotate towards the closed position.

An activation switch 408 may be mounted proximate the first longitudinal edge 402, the activation switch 408 transitioning between an on state and an off state. The activation switch 408 may control the flow of an electric current to both the first melting panel 112 and the second melting panel 114. The electric current functioning to generate the heat needed to melt the snow and ice positioned on the first and second melting panel 112, 114.

Specifically, the activation switch 408 may be in an open state while the second melting panel 114 is in the open position, thereby preventing the flow of electric current through the first and second melting panel 112, 114. Once the second melting panel 114 rotates toward the closed position, the activation switch may transition to the closed state, thereby enabling the flow of electric current through the first and second melting panel 112, 114.

The second longitudinal edged 404 of the second melting panel 114 may be curved as to form a lip 410, The lip 410 may run along one or more portions of the second longitudinal edged 404. Alternatively, the lip 410 may run for the full length of the second longitudinal edge 404 of the second melting panel 114.

The lip 410 may further include an embedded grating pattern 412. The grating pattern 412 may be designed to block debris while allowing the passage of liquids or semi-liquids through the lip 410.

In one embodiment, the grating pattern 412 may be comprised of a series of circular holes spaced generally half an inch apart along the full length of the lip 410. In another embodiment, the grating pattern 412 may be comprised of a series of circular holes spaced generally half an inch apart along opposite end portions of the length of the lip 410.

Figure 5A:
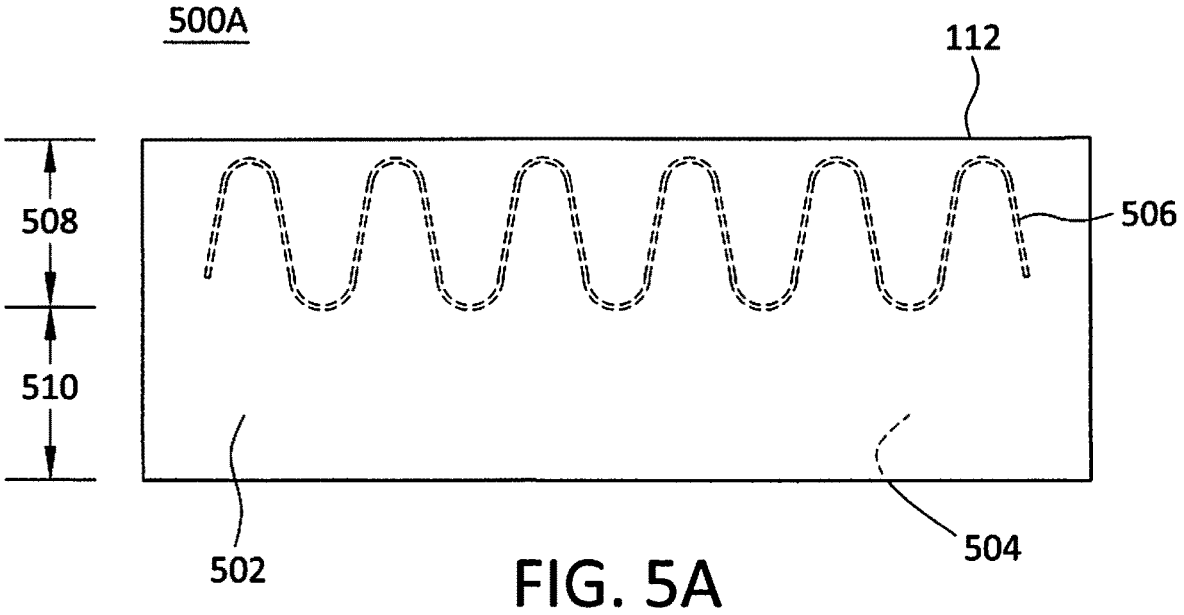
FIG. 5A illustrates a top view of the first melting panel in accordance with the embodiments provided herein.

FIG. 5A illustrates a top view 500A of the first melting panel 112 in accordance with the embodiments provided herein. The first melting panel 112 may be planar with a generally rectangular shape including an upper outer surface 502 and a lower outer surface 504.

A first heating element 506 may be either embedded within the first melting panel 112 or attached to one or both of the upper and lower outer surface 502, 504 of the first melting panel 112.

The first heating element 506 may be positioned within or on an upper portion 508 of the first melting panel 112.

Alternatively, the first heating element 506 may be positioned within only a lower portion 510 of the first melting panel 112. Moreover, the first heating element 506 may be positioned within both the upper and the lower portion 508, 510 of the first melting panel 112.

The first heating element 506 may be configured within or on the first heating panel 112 as a repeating pattern. The repeating pattern may be any repeating pattern known to one of ordinary skill in the art including a sine pattern, a square pattern, a triangle pattern, and a sawtooth pattern or any combination thereof.

In one embodiment, a maximum distance of 12 inches exists between repeating portions of the first heating element 506.

Figure 5B:
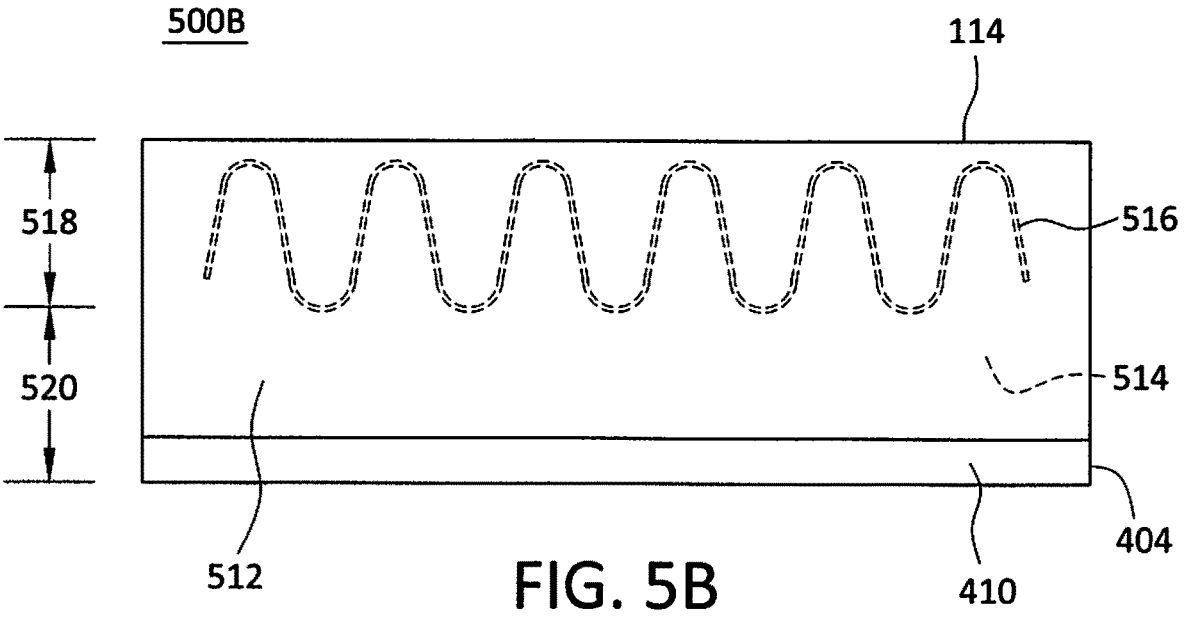
FIG. 5B illustrates a top view of the second melting panel in accordance with the embodiments provided herein.

FIG. 5B illustrates a top view 500B of the second melting panel 114 in accordance with the embodiments provided herein. The second melting panel 114 may be planar with a generally rectangular shape including an upper outer surface 512 and a lower outer surface 514. As described above, the second melting panel 114 may further include a lip 410 running along the second longitudinal edge 404.

The second melting panel 114 may include a second heating element 516 either embedded within the second melting panel 114 or attached to one or both of the upper and lower outer surface 512, 514.

The second heating element 516 may be positioned within only an upper portion 518 of the second melting panel 114. Alternatively, the second heating element 516 may be positioned within only a lower portion 520 of the second melting panel 114, including the lip 410. Moreover, the second heating element 516 may be positioned within both the upper and lower portions 518, 520, including the lip 410.

The second heating element 516 may be configured as a repeating pattern within or on the outer surfaces of the second melting panel 114. The repeating pattern may be any repeating pattern known to one of ordinary skill in the art including a sine pattern, a square pattern, a triangle pattern, and a sawtooth pattern or any combination thereof.

In one embodiment, a maximum distance of 12 inches exists between any of the repeating portions of the second heating element 516.

The first and second heating element 506, 516 may be a resistive type heating element. A resistive type heating element generates heat when an electric current is passed through them. The quantity of heat generated is a function of the resistive nature of the design of the heating element and the amount of current passed through the heating element.

In one embodiment, the first and second heating element 506, 516 may be metallic alloy, ceramic, or ceramic metal or any combination thereof known to one of ordinary skill in the art.

In one embodiment, the first and second heating element 506, 516 may each generate between 180 and 190 BTUs of heat.

The first and second melting panel 112, 114 may be composed of one or more materials that act as effective heat conductors. The one or more materials efficiently distributing heat generated by the first and second heating element 506, 516 throughout the first and second melting panel 112, 114.

In one embodiment, the first and second melting panel 112, 114 may be any metal know to one of ordinary skill in the art including copper, aluminum, brass, steel, and bronze or any combination thereof.

In one embodiment, the first and second heating element 506, 516 heat and maintain the first and second melting panel 112, 114 to a temperature ranging between 490 and 510 degrees Fahrenheit while and averaging approximately 500 degrees Fahrenheit.

Figure 6:
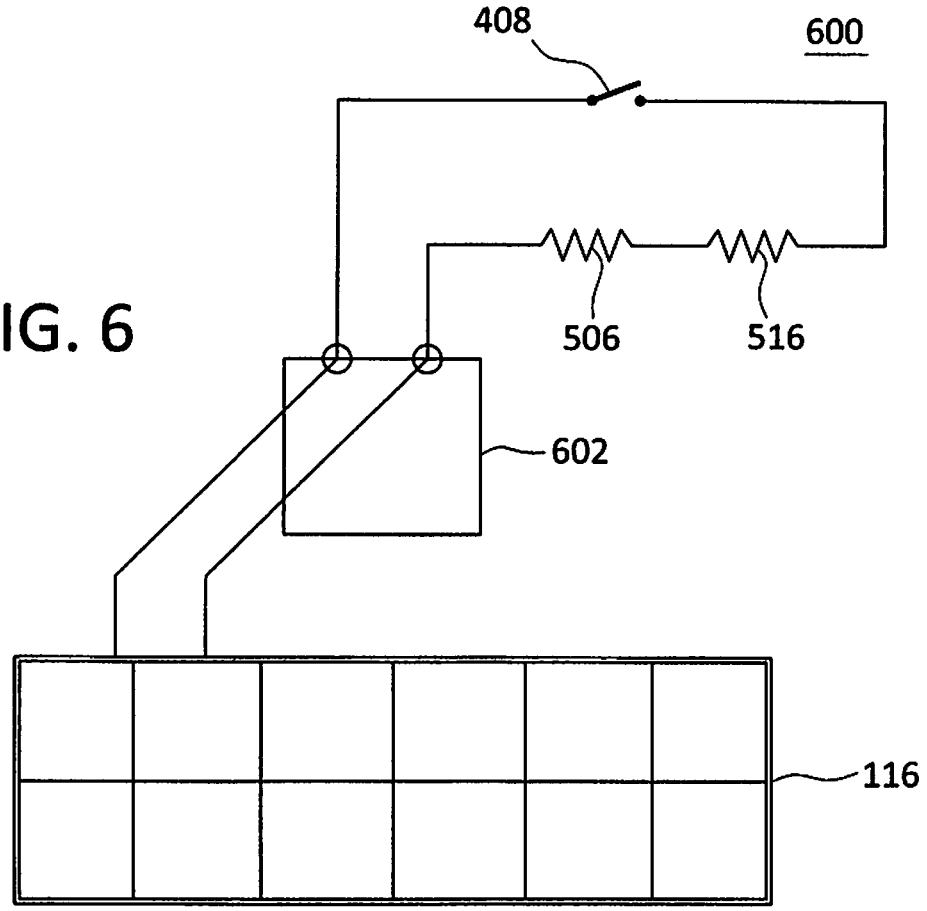
FIG. 6 illustrates a schematic representation of the electrical circuit within the portable snow and ice eliminator apparatus in accordance with the embodiments provided herein.

FIG. 6 illustrates a schematic representation of the electrical circuit 600 within the portable snow and ice eliminator apparatus 100 in accordance with the embodiments provided herein. The electric circuit 600 may include a battery 602, the activation switch 408, the first heating element 506, the second heating element 516, and the solar panel 116.

The first heating element 506, the second heating element 516, and the activation switch 408 may be electrically wired in series with the battery 602.

The activation switch 408 may be a single pole single throw switch that transitions between an open state and a closed state. In the closed state, the activation switch 408 allows for a flow of current originating from the battery 602 through the first heating element 506 and the second heating element 516. In the open state, the activation switch 408 prevents the flow of current originating from the battery 602 through the first heating element 506 and the second heating element 516.

The battery 602 may be a rechargeable battery positioned and secured within the internal cavity 110 of the hopper 102 (not shown). The battery 602 is the source of the current flow through the first and second heating element 506, 516 when the activation switch 408 is in the closed state.

In one embodiment, the battery 602 is a lithium type rechargeable battery rated at 12000 mAh.

The solar panel 115 may be electrically connected directly to the battery 602. The solar panel 116 may recharge the battery 602 while the activation switch 408 is in the open state.

In one embodiment, solar panel 115 is comprised of at least four individual panels, each of the individual panels having a power rating of approximately 1000 watts.

Figure 7:
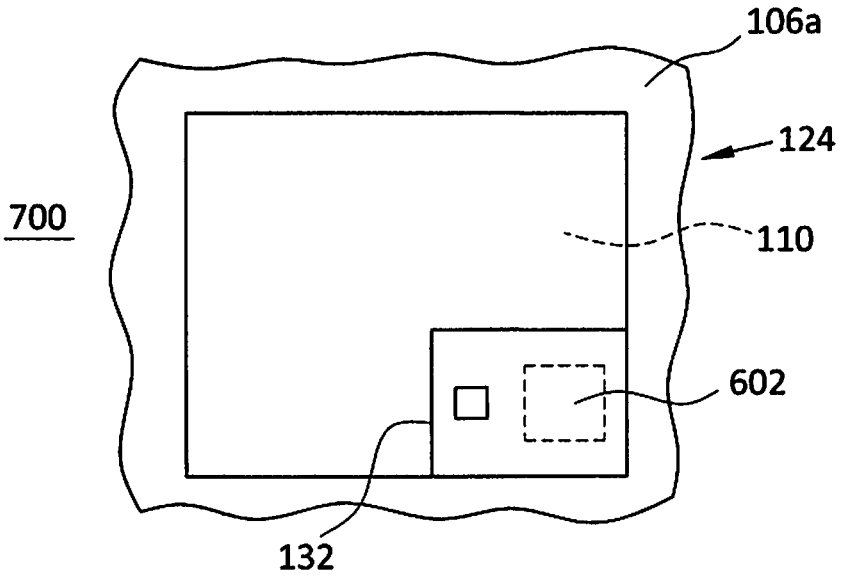
FIG. 7 illustrates a front view of the front end of the hopper in accordance with the embodiments provided herein.

FIG. 7 illustrates a front view 700 of the front end 124 of the hopper 102 in accordance with the embodiments provided herein. The battery 602 may be positioned and secured within a portion of the internal cavity 110 that may be accessed through the access door 132 included on the first end wall 106*a*.

Figure 8A:
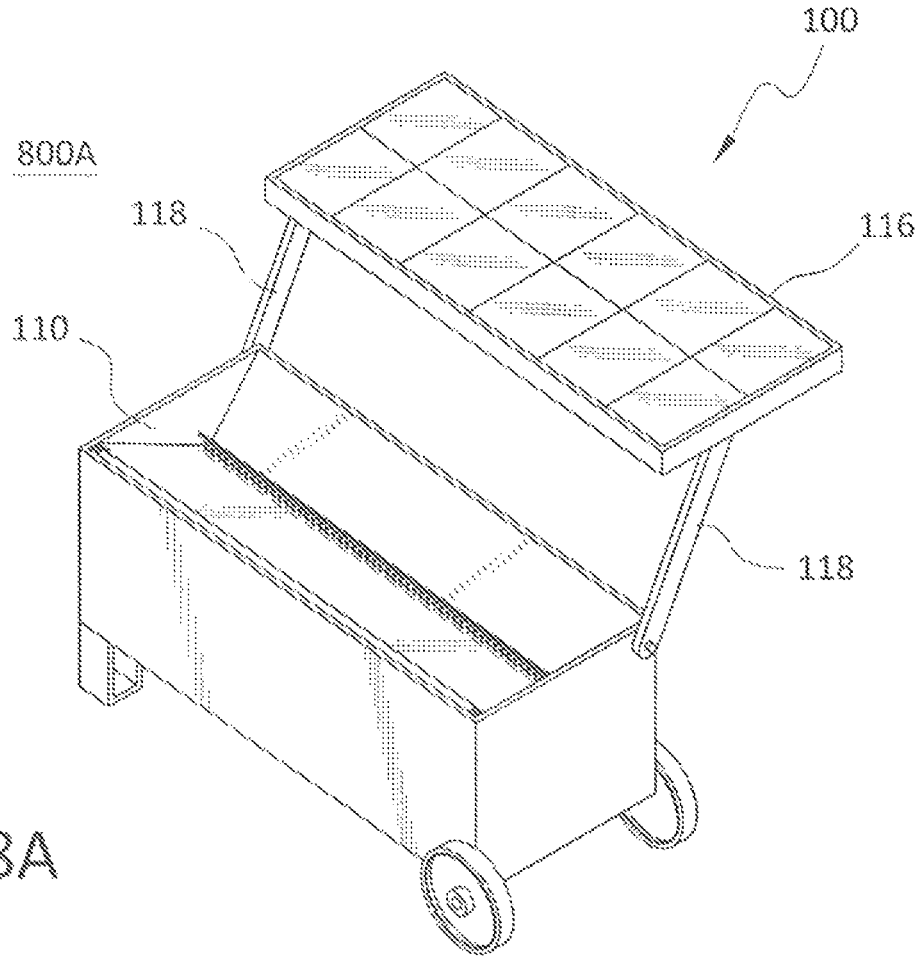
FIG. 8A illustrates a top perspective view of a portable snow and ice eliminator apparatus with a solar panel in an operating position in accordance with the embodiments provided herein.

FIG. 8A illustrates a top perspective view 800A of a portable snow and ice eliminator apparatus 100 with a solar panel 116 in an operating position in accordance with the embodiments provided herein. In the operating position, the elevating arms 118 raise and pitch the solar panel 116 to a position that is remote to the internal cavity 110. In this position, access to the internal cavity 110 is unobstructed by the solar panel 116.

Figure 8B:
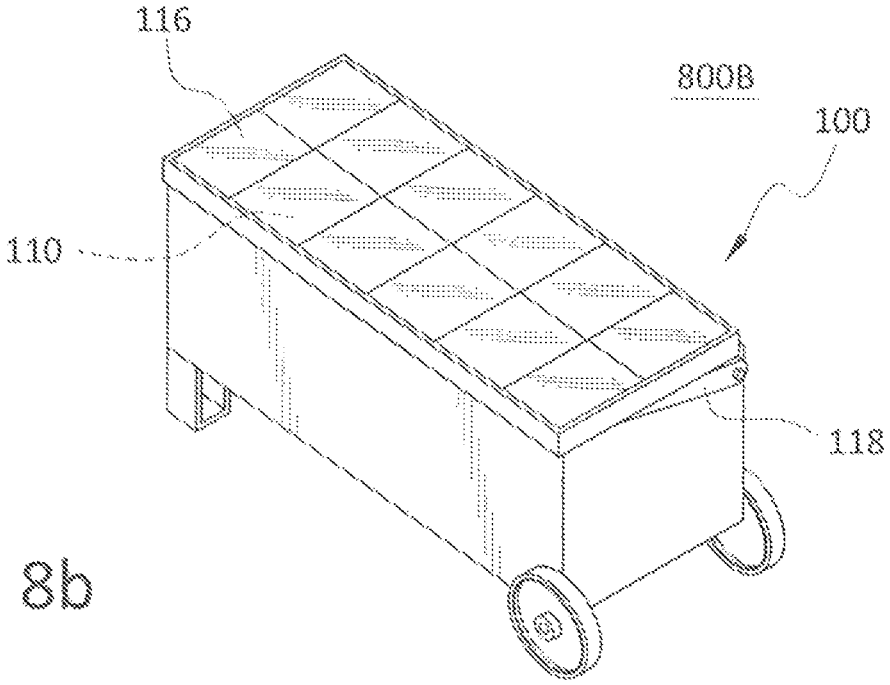
FIG. 8B illustrates a top perspective view of a portable snow and ice eliminator apparatus with a solar panel in a storage position in accordance with the embodiments provided herein.

FIG. 8B illustrates a top perspective view 800B of a portable snow and ice eliminator apparatus 100 with the solar panel 116 in a storage position in accordance with the embodiments provided herein. In the storage position, the elevating arms 118 lower and pitch the solar panel 116 to a position that is proximate to the internal cavity 110. In this position, access to the internal cavity 110 is obstructed by the solar panel 116.

Figure 9:
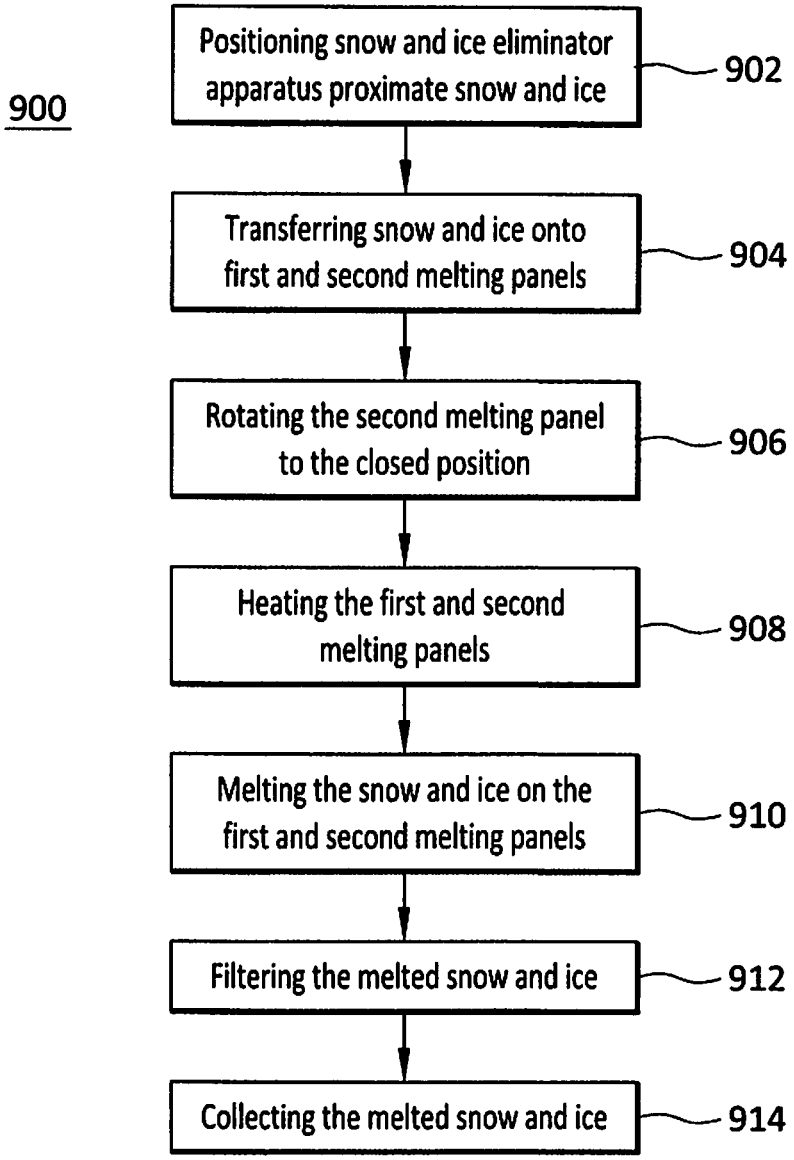
FIG. 9 illustrates a flowchart depiction a method of melting snow and ice within a portable snow and ice eliminator apparatus in accordance with the embodiments provided herein.

FIG. 9 illustrates a flowchart depiction a method 900 of eliminator snow and ice within a portable snow and ice eliminator apparatus 100 in accordance with the embodiments provided herein. The method 900 includes, in step 902, positioning a portable snow and ice eliminator apparatus 100 proximate snow and ice that is to be eliminated.

The method 900 further includes, in step 904, transferring snow and ice to be eliminated onto a first melting panel and a second melting panel within an internal cavity of the portable snow and ice eliminating apparatus.

The method 900 further including, in step 906, rotating the second melting panel from an open position remote from the first melting panel to a closed position proximate to the first melting panel as a result of the weight of the transferred snow and ice positioned on the second melting panel.

The method 900 further including, in step 908, heating the first melting panel and second melting panel using a flow of current through both the first melting panel and the second melting panel, the flow of current enabled by the rotation of the second melting panel to the closed position.

The method 900 further including, in step 910, melting the transferred snow or ice using heat emanating from the first melting panel and the second heating panel.

Lastly, the method 900 further including, in step 912, collecting a melted portion of the transferred snow and ice in a water collector positioned within the internal cavity, below the first melting panel and the second melting panel.

The foregoing description discloses only example embodiments. Modifications of the above-disclosed assemblies and methods which fall within the scope of this disclosure will be readily apparent to those of ordinary skill in the art.

This disclosure is not intended to limit the invention to the particular assemblies and/or methods disclosed, but, to the contrary, the intention is to cover all modifications, equivalents, and alternatives falling within the scope of the claims.

What is claimed is:

1. A portable snow and ice eliminator apparatus comprising:

a hopper for receiving snow or ice to be melted to a liquid or semi-liquid state, the hopper being generally rectangular with opposite side walls and opposite end walls, the opposite side walls and the opposite end walls extending vertically from a base as to define an internal cavity;

a first melting panel fixedly coupled to a first side wall of the opposite side walls and extending substantially over a length of the internal cavity and half of a width of the internal cavity;

a second melting panel rotatably coupled to a second side wall of the opposite side walls and extending substantially over the length of the internal cavity and substantially half of the width of the internal cavity, the second melting panel rotating between an open position and a closed position;

a first heating element embedded within the first melting panel and a second heating element embedded within the second melting panel;

a switch coupled to the second melting panel, the switch being in an off state while the second melting panel is in the open position and an on state while the second melting panel is in the closed position;

a rechargeable battery positioned within the internal cavity and electrically connected to the first heating element and the second heating element through the switch; and a solar panel mechanically coupled to the hopper and electrically connected to the rechargeable battery, the solar panel transitioning between a storage position proximate the internal cavity and an operating position remote of the internal cavity.

2. The portable snow and ice eliminator apparatus of claim 1 wherein the first melting panel and the second melting panel are each slanted towards one another as they approach the base and the second melting panel is in the closed position within the internal cavity.

3. The portable snow and ice eliminator apparatus of claim 1 wherein the first melting panel is at a 45-degree or less angle relative to the first side wall and the second melting panel is at or less than a 45-degree angle relative to the second side wall while in the closed position.

4. The portable snow and ice eliminator apparatus of claim 1 wherein a gap exists between longitudinal edges of the first melting panel and the second melting panel closest to the base while the second melting panel is in the closed position.

5. The portable snow and ice eliminator apparatus of claim 1 wherein the second melting panel includes a curved lip running along a longitudinal edge of the second melting panel.

6. The portable snow and ice eliminator apparatus of claim 5 wherein the curved lip includes a grating pattern.

7. The portable snow and ice eliminator apparatus of claim 1 further comprising a water collector positioned above the base and below the first melting panel and the second melting panel, the water collection extending substantially over the base.

8. The portable snow and ice eliminator apparatus of claim 7 further comprising a water release valve coupled to and passing through a first end wall of the opposite end walls, the water release valve in communication with the water collector.

9. The portable snow and ice eliminator apparatus of claim 8 wherein the water collector is slanted as to bias snow or ice melted to a liquid or a semi-liquid state within the water collector towards the water release valve.

10. The portable snow and ice eliminator apparatus of claim 7 further comprising a screen member positioned below the first and second melting panels and above the water collector, the screen member extending substantially over the base.

11. The portable snow and ice eliminator apparatus of claim 10 wherein the screen member is comprised of multiple stacked individual screens.

12. The portable snow an ice eliminator apparatus of claim 1 wherein the first heating element is embedded within an upper portion the first melting panel and the second heating element is embedded within an upper portion of the second melting panel.

13. The portable snow and ice eliminator apparatus of claim 12 wherein the first melting panel and the second melting panel are each composed of a heat conducting material that conducts heat from the upper portion of the first and second melting panels.

14. The portable snow and ice eliminator apparatus of claim 1 wherein the first heating element and the second heating element are each composed of a metal selected from a group that includes copper, aluminum, brass, steel, and bronze or any combination thereof.

15. The portable snow and ice eliminator apparatus of claim 1 wherein the first heating element and the second heating element each produce between 180 and 190 BTUs of heat transmitted to the first melting panel and the second melting panel, respectively.

16. The portable snow and ice eliminator apparatus of claim 15 wherein the first melting panel and the second melting panel are each heated to and maintained at a temperature between 450- and 500-degrees Fahrenheit.

17. The portable snow and ice eliminator apparatus of claim 1 further comprising a spring coupled between the second melting panel and the second side wall, the spring biasing the second melting panel towards the open position.

18. The portable snow and ice eliminator apparatus of claim 1 wherein the rechargeable battery is a lithium type of rechargeable battery rated at 12000 mAh.

19. A method of eliminating snow and ice, comprising:

positioning a portable snow and ice eliminator apparatus proximate snow and ice to be eliminated;

transferring snow and ice to be eliminated onto a first melting panel and a second melting panel positioned within an internal cavity 110 of the portable snow and ice eliminator;

rotating the second melting panel from an open position remote from the first melting panel to a closed position that is proximate to the first melting panel as a result of a weight of the snow and ice positioned on the second melting panel;

heating the first melting panel and second melting panel using a flow of current through both the first melting panel and the second melting panel, the flow of current enabled by the rotation of the second melting panel;

melting deposited snow or ice by using heat emanating from the first melting panel and the second melting panel; and collecting a melted portion of the snow and ice in a water collector positioned within the internal cavity, below the first melting panel and the second melting panel.

* * * * *